US006332692B1

(12) United States Patent
McCurdy

(10) Patent No.: US 6,332,692 B1
(45) Date of Patent: Dec. 25, 2001

(54) ROLLER SKATE LIGHT SYSTEM

(75) Inventor: Sullivan V. McCurdy, Radcliff, KY (US)

(73) Assignee: Creative Lighting, Inc., Radcliff, KY (US)

( * ) Notice: Subject to any disclaimer, the term of this patent is extended or adjusted under 35 U.S.C. 154(b) by 0 days.

(21) Appl. No.: 09/368,779

(22) Filed: Aug. 5, 1999

(51) Int. Cl.[7] ..... F21V 21/08
(52) U.S. Cl. ..... 362/103; 362/500; 362/570
(58) Field of Search ..... 362/103, 500, 362/544, 545, 554, 555, 570, 800; 280/11.19, 809, 811, 816

(56) References Cited

U.S. PATENT DOCUMENTS 2,140,224 * 12/1938 Galgoczy ..... 362/103
2,502,566 * 4/1950 Hooley ..... 362/103
5,484,164 1/1996 McInerney et al. .
5,536,074 * 7/1996 Hsu et al. ..... 362/78
5,544,026 8/1996 Holbrook .
5,552,971 9/1996 Madden .
5,588,734 12/1996 Talamo et al. .
5,632,548 5/1997 Mayfarth .
5,673,502 10/1997 Caterbone .
5,716,119 2/1998 Patel .
5,855,382 * 1/1999 Reilly et al. ..... 362/103

* cited by examiner

*Primary Examiner*—Y. My Quach-Lee
(74) *Attorney, Agent, or Firm*—Carrithers Law Office; David W. Carrithers

(57) ABSTRACT

A ground effect light system for roller blade, roller skate, or the like including a power source in the from of a battery pack mounted onto the roller blade or skate boot platform within a removal cartridge. A plurality of lights are mounted in a cartridge insertable within an existing wheel well upon removal of a skate wheel. Lights are emitted from a bulb or preferably LED's contained within a cartridge suspended within the wheel well of the skate platform frame illuminating the skate surface thereunder showing a design, one or more lines, rectangle, or other shapes from inbetween the wheels with light beams of selected colored lights. Upon activation, the lights shine upon the ground below the skater to indicate, highlight, and accent the presence of the roller blade skater.

18 Claims, 2 Drawing Sheets

ROLLER SKATE LIGHT SYSTEM

BACKGROUND OF THE INVENTION

1. Technical Field

This invention relates to safety devices for roller skates and roller blades and more particularly to a light system for providing ground effects and illuminating the skates of the skater for show and as a safety consideration by drawing attention to the skater.

2. Description of Prior Art

The use of roller skates and particularly in-line skates such as roller blades are very popular for recreational use. Often skaters will skate near dusk or at night in parking lots and the like. Reflective strips and the like do not provide adequate protection in poorly lit areas. Conventional battery powered skate lights provide front headlights, stop lights, and lights on the skate.

Moreover, skate light systems currently on the market utilize a beam on the boot as a front headlight, red lens on the boot actuated by a pressure means showing a stop light, or by lights extending from the side of the boot.

SUMMARY OF THE INVENTION

The present invention provides a roller skate light system for use with conventional roller skates or roller blade in-line skates including a clear or colored light element which is contained within a removable cartridge and provides directional light shining in a confined area below the skate in a selected light pattern to illuminate the ground beneath the skater. The light may be of a selected color or plurality of colors and also creates a light pattern below the skate. It should be noted that the light source is not intended to illuminate the area in front of the skater or provide a brake light. A power pack and electrical switching element are provided such that the user can place the circuit into an "on" position to illuminate the colored elements of the ground effect lights. Moreover, a plurality of lights may not only be used to illuminate the area beneath the skate, but may be used to direct light upwardly toward the skater.

BRIEF DESCRIPTION OF THE DRAWINGS

A better understanding of the present invention will be had upon reference to the following description in conjunction with the accompanying drawings in which like numerals refer to like parts throughout the several views and wherein.

SPECIFICATION

The roller skate light system 10 of the present invention is manufactured from readily available materials and simple in design. The battery case and lens of the preferred embodiment is comprised of plastic or combinations of metal and plastic. The light source may be selected from LED'S, a conventional light bulb, or a laser.

Figure 1:
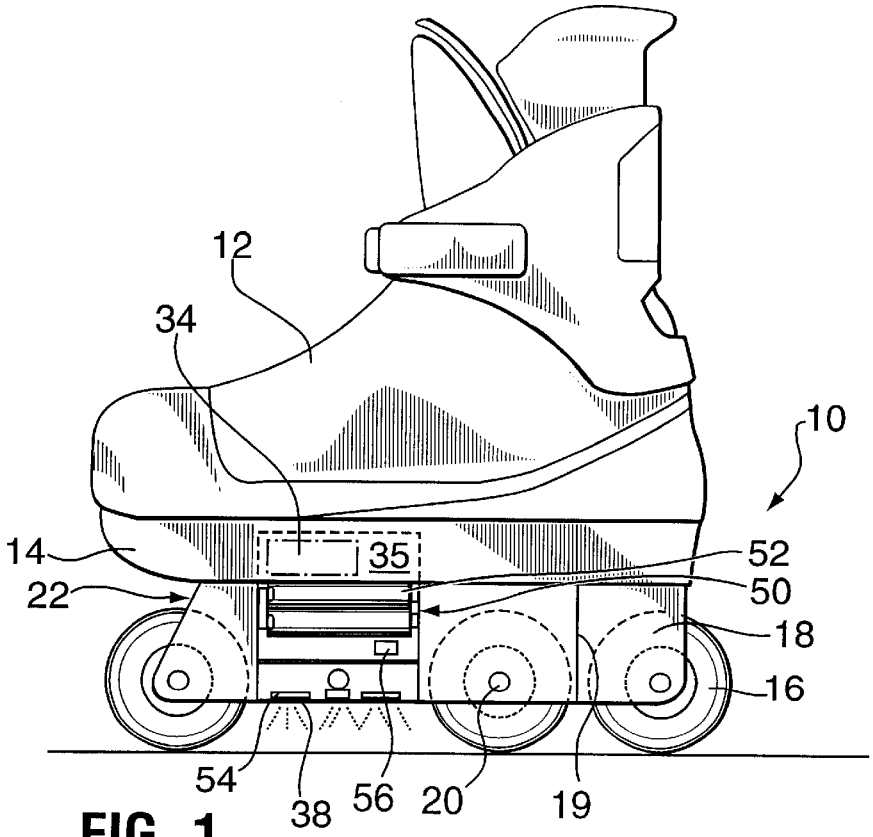
FIG. 1 is a partial cutaway side view of the roller skate light system of the present invention showing the boot of the standard roller blade mounted onto a base supported by in-line skates having an on/off switch for each light emitting cartridge including conventional electrical circuitry, battery pack and light emitting source such as LED's within the well wheel of the skate frame shining downward from the base inbetween the wheels.
Figure 3:
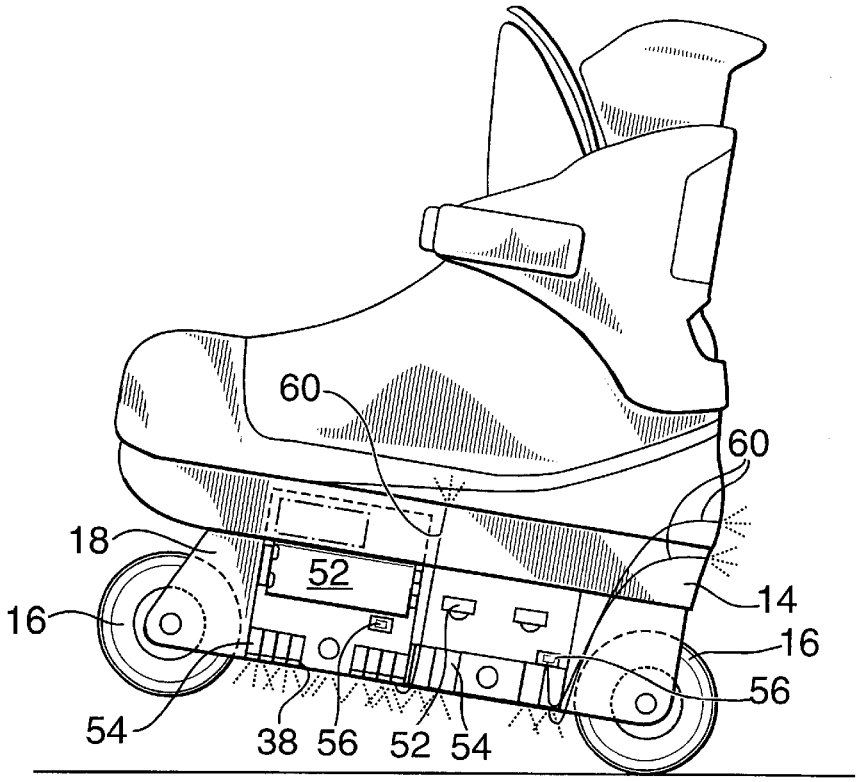
FIG. 3 is a partial cutaway side view of the roller skate light system of FIG. 1, showing the exterior of the skate and boot and the lights illuminating from a pair of removable cartridges inserted into wheel wells between the rear and front wheels of the skate.
Figure 2:
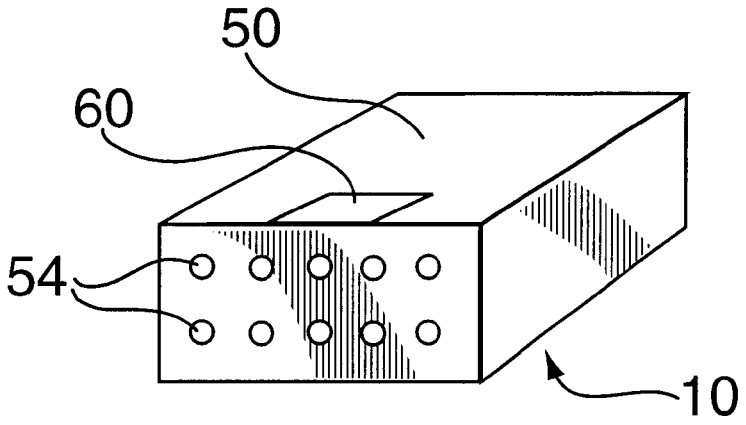
FIG. 2 is a perspective view of a light cartridge for insertion within the frame of an in-line skate in place of a wheel.
Figure 4:
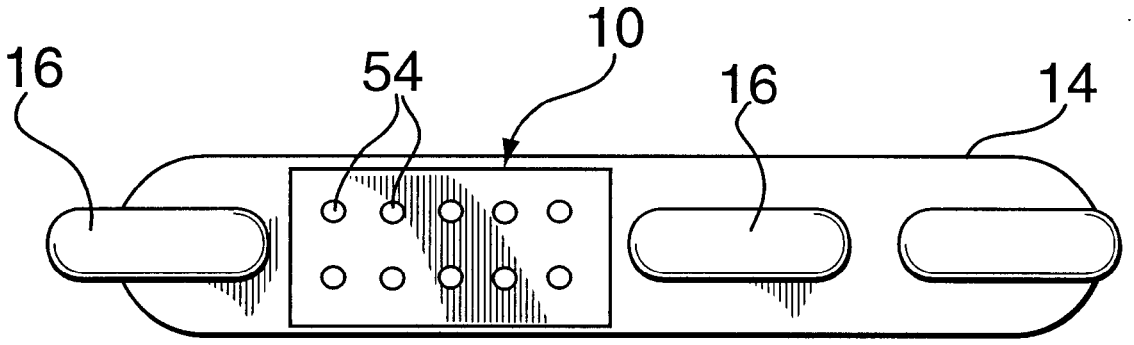
FIG. 4 is a bottom view of the roller skate light system of FIG. 1, showing the roller wheels suspended from the base and a plurality of LED's extending from the bottom of a removal cartridge for insertion into the skate base frame inbetween the roller wheels.

Referring now to the drawings, FIGS. 1–4 show a preferred embodiment of the roller skate light system 10 comprising an upper boot 12 attached to a generally rectangular shaped base or platform 14 including a mounting bracket 22 defining a pair of spaced apart and aligned side flanges 18 extending downward therefrom. Some skates also include partitions 19 projecting downward a selected distance from the base 14 inbetween the wheels 16 to aid in the prevention of debris from jamming inbetween the skates. A plurality of roller wheels 16 are mounted on axles 20 defining screws, pins, or bolts, extending inbetween the side flanges 18.

A removal cartridge 50 comprising a rectangular shaped container containing a power source such as a battery 52 connecting to at least one and preferably a plurality of lights 54 comprising light bulbs or preferably light emitting diodes (LED's). A switch 56 such as a slide switch or push button switch activates the lights by completing the circuit with the battery power source 52. In the preferred embodiment, the lights 54 are used to provide a ground effect accenting the skater and are confined to a specific area. The LED's 54 may be selected having a particular intensity, color, or direction in order to provide the desired ground effect and illuminate the ground below the skater providing a safer skating environment and controlled illumination.

The cartridge 50 is removal and inserted into a wheel well upon removal of a skate wheel 16. A plurality of cartridges 50 may be enclosed within separate wheel wells, one within each wheel well, or several smaller cartridges 50 may be layered and inserted into one wheel well as a means for changing the color of the LED's. The cartridge 50 may be held into position within the skate by a friction fit, by retaining tabs, by a VELCRO hook and loop means strapped to the base 14, and preferably a hole or shaft is formed within the side of the cartridge 50 which is designed to fit snugly within the cavity of the wheel well, wherein the hole accommodates the bolt, screw, or pin which holds the removable wheel 16 therein.

The battery pack 52 may also be in electrical communication with a circuit board 34 is mounted within a cavity 35 formed in the cartridge. The circuit board may contain a program whereby the lights turn on and off or strobe in a particular sequence. Light is transmitted from the lens 38 upon activation by a manual switch 56. The lens 38 is preferably red in color, but all or a portion of the lens 38 may be clear. It is contemplated that the lens 38 may be transparent, translucent, or any color.

It is also contemplated that the light may be transmitted from a central light source (bulb) or directly from the LED's through one or more fiber optic cables 60 mounted in or to the skate boot 12 and or platform 14 to specific points wherein the color of the fiber optic cables transmits light of a selected color to a selected point on the boot 12, wheel 16, skater, or on the skating surface there beneath.

While the preferred embodiment utilizes a battery pack within the cartridge 50, the cartridge may be designed as a frame to hold only the lights, or lights and circuitry. The off/on switch and or the power source may be contained within a cavity formed in the skate base platform 14 so that several light cartridges and/or fiber optic cables in communication with the light cartridges can be operated simultaneously or independently of one another to produce the desired highlighting and ground effects for the skater.

Finally, the present invention may be retrofitted to ice skates, wherein a light cartridge, either removable or of permanent nature can be fitted to the base of the base of ice skates to highlight the ice skaters and/or create ground effects.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A skate light system, comprising:

a base forming a generally longitudinal plate including at least one pair of side flanges projecting downwardly therefrom supporting at least one pair of axles thereinbetween and at least one roller wheel mounted on each axle;

a cartridge for inserting inbetween said wheels, said cartridge including a means for holding to a bottom surface of said base, said cartridge including at least one light;

a portable electrical power source in electrical communication with said light positioned within said cartridge, and means for activating said power source in electrical communication therewith.

2. The skate light system of claim 1, wherein said cartridge is removable.

3. The skate light system of claim 1, wherein said power source is a battery.

4. The skate light system of claim 1, wherein said at least one light is selected from the group of lights consisting of an LED light, light bulb, laser light, and combinations thereof.

5. The skate light system of claim 1, wherein said light is directed through a lens toward the ground producing a ground effect pattern.

6. The skate light system of claim 1, including a fiber optic cable extending from and in radiant communication said light transmitting said light to a selected location illuminating a particular area of said skate.

7. The skate light system of claim 1, including transmitting said light from said cartridge through a fiber optic cable in radiant communication with said light and directing said light toward a skater supported by said base highlighting the skater.

8. The skate light system of claim 1, including a boot attaching to a top surface of said base.

9. A skate light system, comprising:

a longitudinal base having a cavity therein for inserting a light cartridge including at least one light therein;

means for holding said light cartridge within said cavity of said longitudinal base;

a portable power source in electrical communication with said light;

means for activating said power source;

a boot attachable to a top surface of said base.

10. The skate light system of claim 9, wherein said cartridge is removable.

11. The skate light sytem of claim 9, wherein said power source is a battery.

12. The skate light system of claim 9, wherein said at least one light is selected from the group of lights consisting of an LED light, light bulb, laser light, and combinations thereof.

13. A skate light system, comprising:

a longitudinal base having a cavity therein for inserting a removable light cartridge including at least one light therein;

means for holding said light cartridge within said cavity of said longitudinal base;

a portable battery power source in electrical communication with said light;

means for activating said power source;

a boot attachable to a top surface of said base;

said at least one light is selected from the group of lights consisting of an LED light, light bulb, laser light, and combinations thereof; and said light is directed toward the ground producing a ground effect pattern.

14. The skate light system of claim 8, including transmitting said light from said cartridge through a fiber optic cable in radiant communication with said light and directing said light toward a skater highlighting the skater.

15. A light system for a manually powered vehicle, comprising:

a base forming a generally longitudinal plate including means for supporting at least one pair of axles comprising a pair of parallel spaced apart flanges extending downwardly from a bottom surface of said base, and at least one roller wheel mounted on each axle;

a cartridge for inserting inbetween said wheels, said cartridge including a means for holding to the bottom surface of said base, said cartridge including at least one light;

a portable electrical power source in electrical communication with said light positioned within said cartridge, and means for activating said power source in electrical communication therewith; and a boot attaching to a top surface of said base.

16. A light system for a manually powered vehicle, comprising:

a base forming a generally longitudinal plate including means for supporting at least one pair of axles extending downwardly from a bottom surface of said base, and at least one roller wheel mounted on each axle;

a cartridge for inserting inbetween said wheels, said cartridge including a means for holding to a cavity formed within the bottom surface of said base, said cartridge including at least one light;

a portable electrical power source in electrical communication with said light positioned within said cartridge, said portable electrical power source being disposed within said cavity of said base; and means for activating said power source in electrical communication therewith.

17. The light system of claim 16, including a boot attaching to a top surface of said base.

18. The light system of claim 16, wherein said means for supporting a pair of axles comprises a pair of spaced apart aligned and parallel projections extending from the bottom surface of said base.

* * * * *